US011495158B2

(12) United States Patent
Feng et al.

(10) Patent No.: US 11,495,158 B2
(45) Date of Patent: Nov. 8, 2022

(54) SPLICING DISPLAY DEVICE

(71) Applicant: Innolux Corporation, Miao-Li County (TW)

(72) Inventors: Yu-Hsin Feng, Miao-Li County (TW); Yu-Tse Lu, Miao-Li County (TW); Ming-Chi Weng, Miao-Li County (TW); Chin-Tai Hsu, Miao-Li County (TW)

(73) Assignee: Innolux Corporation, Miaoli County (TW)

( * ) Notice: Subject to any disclaimer, the term of this patent is extended or adjusted under 35 U.S.C. 154(b) by 0 days.

(21) Appl. No.: 17/503,376

(22) Filed: Oct. 18, 2021

(65) Prior Publication Data

US 2022/0139283 A1 May 5, 2022

Related U.S. Application Data

(60) Provisional application No. 63/108,447, filed on Nov. 2, 2020.

(30) Foreign Application Priority Data

Jul. 6, 2021 (CN) ..... 202110764179.8

(51) Int. Cl.
*G09G 3/20* (2006.01)

(52) U.S. Cl.
CPC ..... *G09G 3/20* (2013.01); *G09G 2300/026* (2013.01); *G09G 2310/0267* (2013.01); *G09G 2310/0275* (2013.01); *G09G 2310/08* (2013.01)

(58) Field of Classification Search
CPC ..... G09G 3/20; G09G 2300/026; G09G 2310/0275; G09G 2310/08
See application file for complete search history.

(56) References Cited

U.S. PATENT DOCUMENTS

2020/0090580 A1 3/2020 Hyeon et al.
2021/0407974 A1* 12/2021 Jiang ..... H01L 25/167

FOREIGN PATENT DOCUMENTS

CN 109979379 7/2019
CN 112335254 2/2021

* cited by examiner

*Primary Examiner* — Gerald Johnson
(74) *Attorney, Agent, or Firm* — JCIPRNET

(57) ABSTRACT

A splicing display device, including a control board, a first panel, and a second panel, is provided. The control board includes an output terminal. The first panel and the second panel are disposed in a same column. The first panel is coupled to the output terminal. The first panel includes a first gate driving unit, a first signal line, a first bypass line, and a second bypass line. The second panel is coupled to the first panel. The second panel includes a second gate driving unit. The control board provides a first signal and a second signal to the first panel through the output terminal. The first signal is transmitted to the first gate driving unit through the first signal line and is transmitted to the second panel through the first bypass line. The second signal is transmitted to the second gate driving unit through the second bypass line.

20 Claims, 12 Drawing Sheets

SPLICING DISPLAY DEVICE

CROSS-REFERENCE TO RELATED APPLICATION

This application claims the priority benefit of U.S. Provisional Application No. 63/108,447, filed on Nov. 2, 2020 and China Application No. 202110764179.8, filed on Jul. 6, 2021. The entirety of each of the above-mentioned patent applications is hereby incorporated by reference herein and made a part of this specification.

BACKGROUND

Technical Field

The invention relates to a display device, and particularly relates to a splicing display device.

Description of Related Art

Splicing display device is a commonly used technology for large-area display requirements, where multiple panels are combined in a splicing manner to achieve a large-area display effect. However, in a process of displaying images by using a conventional splicing display device, there are often obvious differences in display quality between images displayed on different panels. As a result, the splicing display effect is not good.

SUMMARY

The invention is directed to a splicing display device, which is adapted to provide a good splicing display effect.

An embodiment of the invention provides a splicing display device including a control board, a first panel and a second panel. The control board includes an output terminal. The first panel includes a first gate driving unit, a first signal line, a first bypass line, and a second bypass line. The first panel is coupled to the output terminal. The second panel includes a second gate driving unit. The second panel is coupled to the first panel. The first panel and the second panel are disposed in a same column. The control board provides a first signal and a second signal to the first panel through the output terminal. The first signal is transmitted to the first gate driving unit through the first signal line, and is transmitted to the second panel through the first bypass line. The second signal is transmitted to the second gate driving unit through the second bypass line.

Based on the above description, the splicing display device of the disclosure may provide signals to the first panel and the second panel through the same control board, thereby reducing the difference in display quality.

To make the aforementioned more comprehensible, several embodiments accompanied with drawings are described in detail as follows.

DESCRIPTION OF THE EMBODIMENTS

Figure 1:
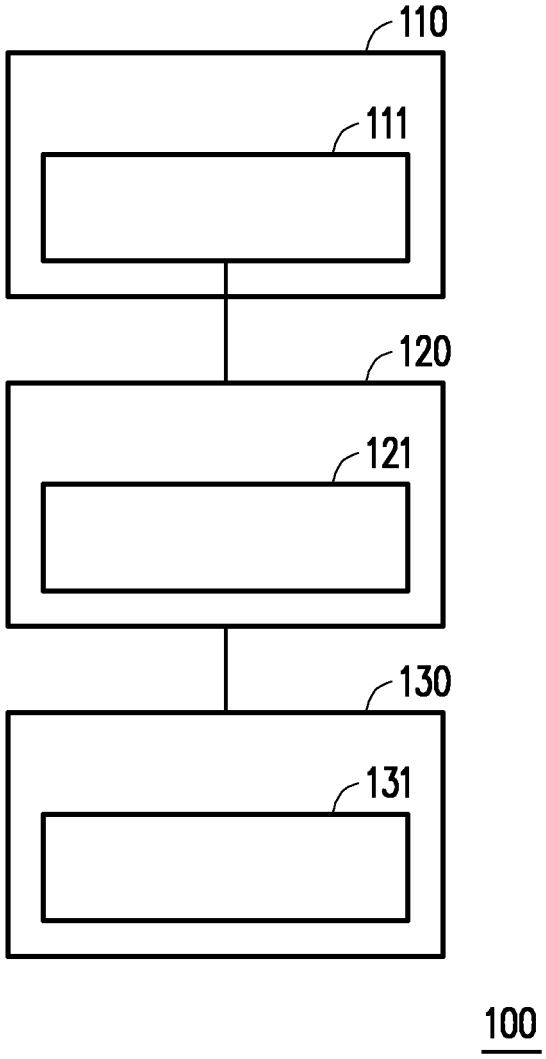
FIG. 1 is a schematic diagram of a splicing display device according to an embodiment of the disclosure.

Reference will now be made in detail to the present preferred embodiments of the invention, examples of which are illustrated in the accompanying drawings. Wherever possible, the same reference numbers are used in the drawings and the description to refer to the same or like parts.

Certain terms are used throughout the specification of the disclosure and the appended claims to refer to specific components. Those skilled in the art should understand that electronic device manufacturers may probably use different names to refer to the same components. This specification is not intended to distinguish between components that have the same function but different names. In the following specification and claims, the terms "containing", "including", etc., are open terms, so that they should be interpreted as meaning of "including but not limited to . . . ".

In some embodiments of the disclosure, terms related to bonding and connection, such as "connect", "interconnect", etc., unless specifically defined, may refer to that two structures are in direct contact, or that two structures are not in direct contact, and other structures are located between these two structures. The terms related to bonding and connection may also include situations that both of the two structures are movable or both of the two structures are fixed. In addition, the terms "electrical connection" and "coupling" include any direct and indirect electrical connection means.

The ordinal numbers used in the specification and claims, such as "first", "second", etc., are used to modify the components, and they do not imply or represent the, or these, components have any previous ordinal numbers, nor do they represent the order of a certain component and another component, or the order in the manufacturing method. The use of these ordinal numbers is only used to clearly distinguish a component with a certain name from another component with the same name. The same terms may not be used in the claims and the specification. Accordingly, a first component in the specification may be a second component in the claims. It should be noted that in the following embodiments, the technical features of several different embodiments may be replaced, reorganized, and mixed without departing from the spirit of the disclosure to complete other embodiments.

It should be noted that in the following embodiments, under the premise of not departing from the spirit of the disclosure, the features in several different embodiments may be replaced, reorganized, and mixed to complete other embodiments. As long as the features of the embodiments do not violate or conflict with the spirit of the invention, they may be mixed and matched arbitrarily.

A splicing display device of the disclosure may include a touch display device, a curved display device, or a non-rectangular display device, but the disclosure is not limited thereto. A plurality of panels spliced by the splicing display device may include, for example, panels of liquid crystal, light emitting diodes (LED), quantum dots (QD), fluorescence, phosphor, other suitable materials, or a combination of the above materials, but the disclosure is not limited thereto. The light emitting diode may include, for example, an organic light emitting diode (OLED), a mini LED, a micro LED, a quantum dot light emitting diode (QLED or QDLED), or other suitable materials, and the materials may be arranged and combined arbitrarily, but the disclosure is not limited thereto.

FIG. 1 is a schematic diagram of a splicing display device according to an embodiment of the disclosure. Referring to FIG. 1, a splicing display device 100 includes a control board 110, a first panel 120 and a second panel 130. The control board 110 includes an output terminal 111. The first panel 120 is coupled to the output terminal 111 of the control board 110. The first panel 120 includes a first gate driving unit (or referred to as a gate driving circuit) 121. The second panel 130 includes a second gate driving unit 131. The second panel 130 is coupled to the first panel 120. The control board 110 provides a first signal and a second signal to the first panel 120 through the output terminal 111. In the disclosure, the first signal and the second signal may refer to a start pulse signal. In the embodiment, the first panel 120 and the second panel 130 may be spliced in a same column to provide a splicing display effect. It should be noted that the control board 110, the first panel 120, and the second panel 130 of the embodiment may be coupled by a cable, where the cable may be, for example, a flexible flat cable (FFC), but this disclosure is not limited thereto.

In the embodiment, the first panel 120 may also be configured with a first signal line (not shown), a first bypass line (not shown), and a second bypass line (not shown). The control board 110 may provide the first signal and the second signal to the first panel 120 through the output terminal 111. In the first panel 120, the first signal may be transmitted to the first gate driving unit 121 through the first signal line, and transmitted to the second panel 130 through the first bypass line. In the first panel 120, the second signal may be transmitted to the second panel 130 through the second bypass line. A signal line (not shown) may also be configured in the second panel 130 to transmit the second signal to the second gate driving unit 131. Therefore, the first panel 120 and the second panel 130 of the embodiment may receive the start pulse signal provided by the same control board 110, so that the first panel 120 and the second panel 130 may have consistent display quality, and may provide good splicing display effect. However, the arrangement of the aforementioned signal lines and bypass lines will be further described in the following multiple embodiments.

Figure 2:
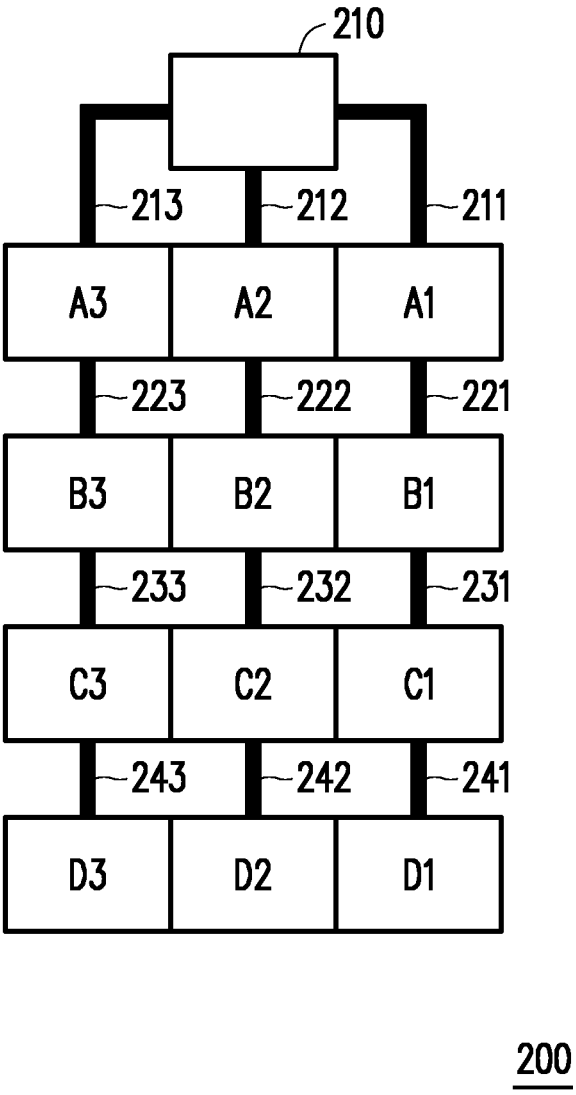
FIG. 2 is a schematic diagram of a splicing operation of a splicing display device according to a first or second embodiment of the disclosure.

FIG. 2 is a schematic diagram of a splicing operation of a splicing display device according to a first or second embodiment of the disclosure. Referring to FIG. 2, a splicing display device 200 may include a plurality of panels A1 to A3, B1 to B3, C1 to C3, D1 to D3 arranged in an array, but the number of the panels in the disclosure is not limited thereto. In the embodiment, the panels A1, B1, C1, and D1 are spliced into a same column. The panels A2, B2, C2, and D2 are spliced into another column. The panels A3, B3, C3, and D3 are spliced into another column. The control board 210 may be coupled to the panels A1 to A3 through cables 211 to 213 to provide a plurality of start pulse signals and data signals used for driving the panels A1 to A3, B1 to B3, C1 to C3, and D1 to D3 to the panels A1 to A3. In this regard, the panels A1 to A3 may respectively perform display driving based on the corresponding start pulse signals and data signals.

In the embodiment, the panels A1 to A3 are respectively coupled to the panels B1 to B3 through cables 221 to 223. The panels A1 to A3 may respectively transmit a plurality of start pulse signals and data signals used for driving the panels B1 to B3, C1 to C3, and D1 to D3 to the panels B1 to B3 through a plurality of bypass lines in the panels A1 to A3 and the cables 221 to 223. In this regard, the panels B1 to B3 may respectively perform display driving based on the corresponding start pulse signals and data signals.

In the embodiment, the panels B1 to B3 are respectively coupled to the panels C1 to C3 through cables 231 to 233. The panels B1 to B3 may respectively transmit a plurality of start pulse signals and data signals used for driving the panels C1 to C3, and D1 to D3 to the panels C1 to C3 through a plurality of bypass lines in the panels B1 to B3 and the cables 231 to 233. In this regard, the panels C1 to C3 may respectively perform display driving based on the corresponding start pulse signals and data signals.

In the embodiment, the panels C1 to C3 are respectively coupled to the panels D1 to D3 through cables 241 to 243. The panels C1 to C3 may respectively transmit a plurality of start pulse signals and data signals used for driving the panels D1 to D3 to the panels D1 to D3 through a plurality of bypass lines in the panels C1 to C3 and the cables 241 to 243. In this regard, the panels D1 to D3 may respectively perform display driving based on the corresponding start pulse signals and data signals.

Figure 3A:
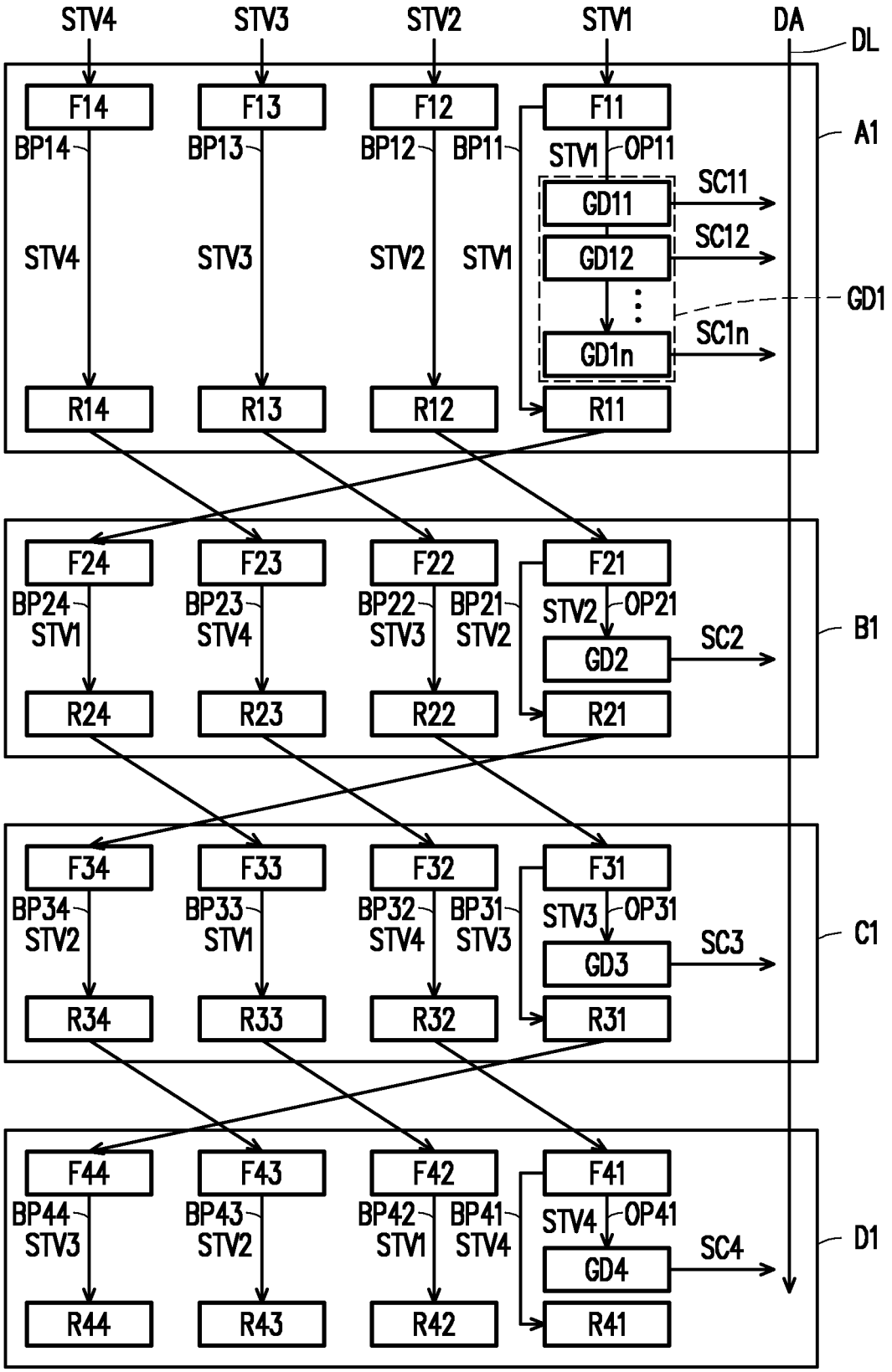
FIG. 3A is a circuit schematic diagram of a plurality of panels spliced into a same column according to the first embodiment of the disclosure.

FIG. 3A is a circuit schematic diagram of a plurality of panels spliced into a same column according to the first embodiment of the disclosure. Referring to FIG. 2 and FIG. 3A, and the following description, the panels A1 to D1 in the same column in FIG. 2 are taken as an example for description. In the embodiment, the panel A1 includes pins F11 to F14, R11 to R14, a multi-stage gate driving unit GD1, bypass lines BP11 to BP14, and a signal line OP11. The panel B1 includes pins F21 to F24, R21 to R24, a multi-stage gate driving unit GD2, bypass lines BP21 to BP24, and a signal line OP21. The panel C1 includes pins F31 to F34, R31 to R34, a multi-stage gate driving unit GD3, bypass lines BP31 to BP34, and a signal line OP31. The panel D1 includes pins F41 to F44, R41 to R44, a multi-stage gate driving unit GD4, bypass lines BP41 to BP44, and a signal line OP41. In addition, the panels A1 to D1 further include a data line DL and other pins to respectively receive a data signal DA provided by the control board 210.

In the embodiment, compared to the pins F12 to F14, the pin R11 is disposed to be closest to the pin F11. Compared to the pins F11, F13, and F14, the pin R12 is disposed to be closest to the pin F12. Compared to the pins F11, F12, and F14, the pin R13 is disposed to be closest to the pin F13.

Compared to the pins F11 to F13, the pin R14 is disposed to be closest to the pin F14. It should be noted that "a certain pin is disposed to be closest to another pin" may refer to that the certain pin is closest to the another pin in space or on a reference plane. In addition, the number of the panels and pins in the figure of the disclosure is only an example, in fact, the number of the panels and pins is not limited thereto.

In the embodiment, the pins F11 to F14 of the panel A1 may respectively receive start pulse signals STV1 to STV4 from the cable 211, and the panel A1 further receives the data signal DA from the cable 211. The start pulse signals STV1 and STV2 may be the first signal and the second signal of the aforementioned embodiment. The pins F11 to F14 of the panel A1 are respectively coupled to the pins R11 to R14 through the bypass lines BP11 to BP14. The pin F11 of the panel A1 is further coupled to the multi-stage gate driving unit GD1. The multi-stage gate driving unit GD1 may include a plurality of gate driving units GD11 to GD1*n*, where n is a positive integer. In the embodiment, the pins F11 to F14 and the pins R11 to R14 are respectively arranged in sequence in a same direction, and are respectively disposed on a first side and a second side of the panel A1. As shown in FIG. 3A, the first side and the second side may not be the same. For example, in FIG. 3A, the first side and the second side may be opposite sides, and in some embodiments, the first side and the second side may be two adjacent sides or the same side.

In the embodiment, the pins F11 to F14 respectively transfer the corresponding start pulse signals STV1 to STV4 to the corresponding pins R11 to R14 through the bypass lines BP11 to BP14. The gate driving unit GD11 is coupled to the pin F11 through the signal line OP11 to receive the start pulse signal STV1. The gate driving unit GD11 may generate a scan signal SC11 and an operation signal (for example, a lighting signal, not shown in the figure) according to the start pulse signal STV1. The gate driving unit GD11 may transmit the scan signal SC11 to a display pixel circuit of the panel A1, and the gate driving unit GD11 may transmit the scan signal SC11 and the operation signal to the gate driving unit GD12 of a next stage to drive the gate driving unit GD12 to generate a corresponding scan signal SC12 and an operation signal according to the scan signal SC11 and the operation signal provided by the gate driving unit GD11 of the previous stage, and successively provide the scan signal SC12 and the operation signal to the gate driving unit GD13 of the next stage. Deduced by analogy, the gate driving unit GD1*n* may receive the scan signal and the operation signal provided by the gate driving unit of the previous stage, and generate a corresponding scan signal SC1*n*. Therefore, the panel A1 may drive a plurality of display pixels of a pixel array in the panel A1 according to the plurality of scan signals SC11 to SC1*n* generated by the gate driving units GD11 to GD1*n* and the data signal DA, so that the panel A1 may display a corresponding image through the pixel array.

In the embodiment, the panel B1 may be spliced to one side of the panel A1 close to the pins R11 to R14. In the embodiment, the pins F21 to F24 and the pins R21 to R24 are respectively arranged in sequence in the same direction, and are respectively disposed on a first side and a second side of the panel B1, where the first side of the second panel is disposed to be closest to the second side of the first panel, and the first side and the second side of the second panel may be opposite sides. In the embodiment, compared to the pins R12 to R14, the pin F21 is disposed to be closest to the pin R11. Compared to the pins R11, R13, and R14, the pin F22 is disposed to be closest to the pin R12. Compared to the pins R11, R12, and R14, the pin F23 is disposed to be closest to the pin R13. Compared to the pins R11 to R13, the pin F24 is disposed to be closest to the pin R14. In the embodiment, compared to the pins F22 to F24, the pin R21 is disposed to be closest to the pin F21. Compared to the pins F21, F23, and F24, the pin R22 is disposed to be closest to the pin F22. Compared to the pins F21, F22, and F24, the pin R23 is disposed to be closest to the pin F23. Compared to the pins F21 to F23, the pin R24 is disposed to be closest to the pin F24.

In the embodiment, the pins F21 to F24 of the panel B1 may respectively receive the start pulse signals STV1 to STV4 from the cable 221, and the panel B1 further receives the data signal DA from the cable 221. It should be noted that the pin F21 is coupled to the pin R12. The pin F22 is coupled to the pin R13. The pin F23 is coupled to the pin R14. The pin F24 is coupled to the pin R11. Therefore, the pin F21 may receive the start pulse signal STV2. The pin F22 may receive the start pulse signal STV3. The pin F23 may receive the start pulse signal STV4. The pin F24 may receive the start pulse signal STV1. In the embodiment, the pins F21 to F24 of the panel B1 are respectively coupled to the pins R21 to R24 through the bypass lines BP21 to BP24. The pin F21 of the panel B1 is further coupled to the multi-stage gate driving unit GD2. Similar to the multi-stage gate driving unit GD1 of the panel A1, the multi-stage gate driving unit GD2 may also include a plurality of gate driving units. However, since the multi-level gate driving unit GD2 may be the same as the multi-level gate driving unit GD1, features and operation methods thereof are not repeated.

In the embodiment, the pins F21 to F24 transmit the start pulse signals STV1 to STV4 to the pins R21 to R24 through the bypass lines BP21 to BP24. The multi-stage gate driving unit GD2 may be coupled to the pin F21 through the signal line OP21 to receive the start pulse signal STV2. A plurality of gate driving units of the multi-stage gate driving unit GD2 may generate a plurality of scan signals SC2 and a plurality of operation signals (not shown) according to the start pulse signal STV2. Therefore, the panel B1 may drive a plurality of display pixels of a pixel array in the panel B1 according to the plurality of scan signals SC2 generated by the multi-stage gate driving unit GD2 and the data signal DA, so that the panel B1 may display a corresponding image through the pixel array.

In the embodiment, the panel C1 may be spliced to one side of the panel B1 close to the pins R21 to R24. In the embodiment, the pins F31 to F34 and the pins R31 to R34 are respectively arranged in sequence in the same direction, and are respectively disposed on a first side and a second side of the panel C1. In the embodiment, compared to the pins R22 to R24, the pin F31 is disposed to be closest to the pin R21. Compared to the pins R21, R23, and R24, the pin F32 is disposed to be closest to the pin R22. Compared to the pins R21, R22, and R24, the pin F33 is disposed to be closest to the pin R33. Compared to the pins R21 to R23, the pin F34 is disposed to be closest to the pin R24. In the embodiment, compared to the pins F32 to F34, the pin R31 is disposed to be closest to the pin F31. Compared to the pins F31, F33, and F34, the pin R32 is disposed to be closest to the pin F32. Compared to the pins F31, F32, and F34, the pin R33 is disposed to be closest to the pin F33. Compared to the pins F31 to F33, the pin R34 is disposed to be closest to the pin F34.

In the embodiment, the pins F31 to F34 of the panel C1 may respectively receive the start pulse signals STV1 to STV4 from the cable 231, and the panel C1 further receives the data signal DA from the cable 231. It should be noted that the pin F31 is coupled to the pin R22. The pin F32 is coupled to the pin R23. The pin F33 is coupled to the pin R24. The pin F34 is coupled to the pin R21. Therefore, the pin F31 may receive the start pulse signal STV3. The pin F32 may receive the start pulse signal STV4. The pin F33 may receive the start pulse signal STV1. The pin F34 may receive the start pulse signal STV2. In the embodiment, the pins F31 to F34 of the panel C1 are respectively coupled to the pins R31 to R34 through the bypass lines BP31 to BP34. The pin F31 of the panel C1 is further coupled to the multi-stage gate driving unit GD3. Similar to the multi-stage gate driving unit GD1 of the panel A1, the multi-stage gate driving unit GD3 may also include a plurality of gate driving units. However, since the multi-level gate driving unit GD3 may be the same as the multi-level gate driving unit GD1, features and operation methods thereof are not repeated.

In the embodiment, the pins F31 to F34 transmit the start pulse signals STV1 to STV4 to the pins R31 to R34 through the bypass lines BP31 to BP34. The multi-stage gate driving unit GD3 may be coupled to the pin F31 through the signal line OP31 to receive the start pulse signal STV3. A plurality of gate driving units of the multi-stage gate driving unit GD3 may generate a plurality of scan signals SC3 and a plurality of operation signals (not shown) according to the start pulse signal STV3. Therefore, the panel C1 may drive a plurality of display pixels of a pixel array in the panel C1 according to the plurality of scan signals SC3 generated by the multi-stage gate driving unit GD3 and the data signal DA, so that the panel C1 may display a corresponding image through the pixel array.

In the embodiment, the panel D1 may be spliced to one side of the panel C1 close to the pins R31 to R34. In the embodiment, the pins F41 to F44 and the pins R41 to R44 are respectively arranged in sequence in the same direction, and are respectively disposed on a first side and a second side of the panel D1. In the embodiment, compared to the pins R32 to R34, the pin F41 is disposed to be closest to the pin R31. Compared to the pins R31, R33, and R34, the pin F42 is disposed to be closest to the pin R32. Compared to the pins R31, R32, and R34, the pin F43 is disposed to be closest to the pin R33. Compared to the pins R31 to R33, the pin F44 is disposed to be closest to the pin R34. In the embodiment, compared to the pins F42 to F44, the pin R41 is disposed to be closest to the pin F41. Compared to the pins F41, F43, and F44, the pin R42 is disposed to be closest to the pin F42. Compared to the pins F41, F42, and F44, the pin R43 is disposed to be closest to the pin F43. Compared to the pins F41 to F43, the pin R44 is disposed to be closest to the pin F44.

In the embodiment, the pins F41 to F44 of the panel D1 may respectively receive the start pulse signals STV1 to STV4 from the cable 241, and the panel D1 further receives the data signal DA from the cable 241. It should be noted that the pin F41 is coupled to the pin R32. The pin F42 is coupled to the pin R33. The pin F43 is coupled to the pin R34. The pin F44 is coupled to the pin R31. Therefore, the pin F41 may receive the start pulse signal STV4. The pin F42 may receive the start pulse signal STV1. The pin F43 may receive the start pulse signal STV2. The pin F44 may receive the start pulse signal STV3. In the embodiment, the pins F41 to F44 of the panel D1 are respectively coupled to the pins R41 to R44 through the bypass lines BP41 to BP44. The pin F41 of the panel D1 is further coupled to the multi-stage gate driving unit GD4. The multi-stage gate driving unit GD4 may include a plurality of gate driving units. However, since the multi-level gate driving unit GD4 may be the same as the multi-level gate driving unit GD1, features and operation methods thereof are not repeated.

In the embodiment, the pins F41 to F44 transmit the start pulse signals STV1 to STV4 to the pins R41 to R44 through the bypass lines BP41 to BP44. Similar to the multi-stage gate driving unit GD1 of the panel A1, the multi-stage gate driving unit GD4 may be coupled to the pin F41 through the signal line OP41 to receive the start pulse signal STV4. A plurality of gate driving units of the multi-stage gate driving unit GD4 may generate a plurality of scan signals SC4 and a plurality of operation signals according to the start pulse signal STV4. Therefore, the panel D1 may drive a plurality of display pixels of a pixel array in the panel D1 according to the plurality of scan signals SC4 generated by the multi-stage gate driving unit GD4 and the data signal DA, so that the panel D1 may display a corresponding image through the pixel array.

The panels A1 to D1 of the embodiment may receive the start pulse signals STV1 to STV4 and the data signal DA output by the same control board 210 to perform display driving operations respectively. Therefore, the panels A1 to D1 of the embodiment may provide a splicing display effect with lower display difference. Moreover, the panels A1 to D1 of the embodiment may transmit the start pulse signals STV1 to STV4 and the data signal DA there between through the cables 221, 231, 241, so that the panels A1 to D1 do not need to be directly connected to the control board 210 through their respective cables to receive the corresponding start pulse signals and the data signal DA. In other words, a cable space among the multiple panels of the splicing display device 200 of the embodiment may be effectively saved through the above-mentioned coupling method.

In addition, in some other embodiments of the disclosure, the panel A1 may not include the bypass line BP11, the panel B1 may not include the bypass line BP21, the panel C1 may not include the bypass line BP31, and the panel D1 may not include the bypass line BP41. Namely, the panels A1 to D1 respectively use the start pulse signals STV1 to STV4 to perform display driving, and the panels A1 to D1 do not need to provide their corresponding start pulse signals STV1 to STV4 to other panels through the bypass lines BP11 to BP41.

Figure 3B:
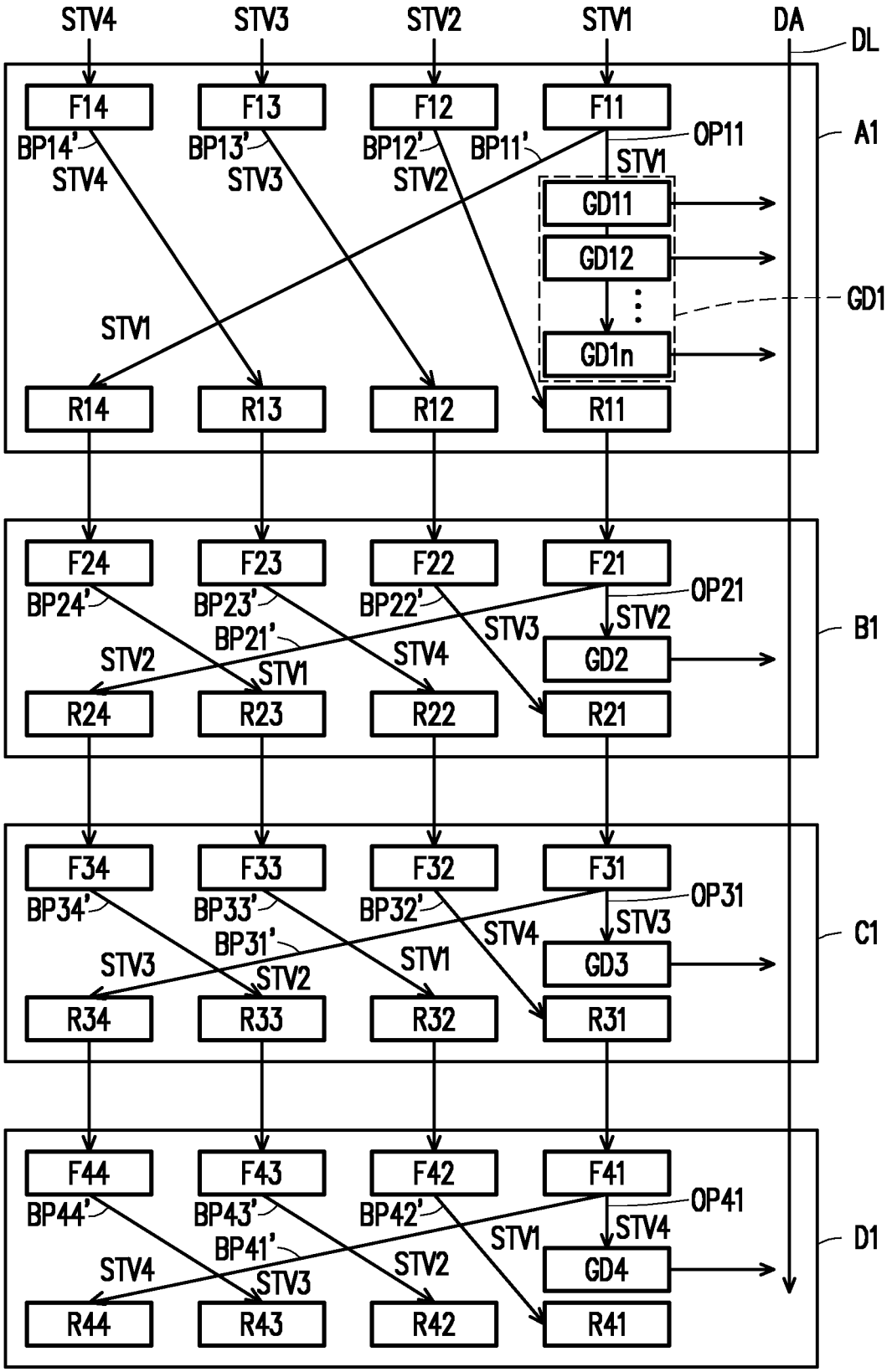
FIG. 3B is a circuit schematic diagram of a plurality of panels spliced into a same column according to the second embodiment of the disclosure.

FIG. 3B is a circuit schematic diagram of a plurality of panels spliced into a same column according to the second embodiment of the disclosure. Referring to FIGS. 2 and 3B, and the panels A1 to D1 in the same column of FIG. 2 will be taken as an example for description. In the embodiment, the panel A1 includes pins F11 to F14, R11 to R14, a multi-stage gate driving unit GD1, bypass lines BP11' to BP14', and a signal line OP11. The panel B1 includes pins F21 to F24, R21 to R24, a multi-stage gate driving unit GD2, bypass lines BP21' to BP24', and a signal line OP21. The panel C1 includes pins F31 to F34, R31 to R34, a multi-stage gate driving unit GD3, bypass lines BP31' to BP34', and a signal line OP31. The panel D1 includes pins F41 to F44, R41 to R44, a multi-stage gate driving unit GD4, bypass lines BP41' to BP44', and a signal line OP41. In addition, the panels A1 to D1 also include a data line DL and other pins to respectively receive the data signal DA provided by the control board 210.

It should be noted that the hardware features of the embodiment are roughly the same as those of FIG. 3A, so that descriptions thereof are not repeated. Main differences between the embodiments of FIG. 3B and FIG. 3A lie in a different arrangement order of the bypass lines BP11' to BP14', BP21' to BP24', BP31' to BP34', and BP41' to BP44', and a different coupling order of a plurality pins of the panels A1 to D1. In the embodiment, in the panel A1, the pin F11 is coupled to the pin R14 through the bypass line BP11' to transmit the start pulse signal STV1. The pin F12 is coupled to the pin R11 through the bypass line BP12' to transmit the start pulse signal STV2. The pin F13 is coupled to the pin R12 through the bypass line BP13' to transmit the start pulse signal STV3. The pin F14 is coupled to the pin R13 through the bypass line BP14' to transmit the start pulse signal STV4. In the embodiment, the pins R11 to R14 of the panel A1 are sequentially coupled to the pins F21 to F24 of the panel B1 through the cable 221 respectively.

In the panel B1, the pin F21 is coupled to the pin R24 through the bypass line BP21' to transmit the start pulse signal STV2. The pin F22 is coupled to the pin R21 through the bypass line BP22' to transmit the start pulse signal STV3. The pin F23 is coupled to the pin R22 through the bypass line BP23' to transmit the start pulse signal STV4. The pin F24 is coupled to the pin R23 through the bypass line BP24' to transmit the start pulse signal STV1. In the embodiment, the pins R21 to R24 of the panel B1 are sequentially coupled to the pins F31 to F34 of the panel C1 through the cable 231 respectively.

In the panel C1, the pin F31 is coupled to the pin R34 through the bypass line BP31' to transmit the start pulse signal STV3. The pin F32 is coupled to the pin R31 through the bypass line BP32' to transmit the start pulse signal STV4. The pin F33 is coupled to the pin R32 through the bypass line BP33' to transmit the start pulse signal STV1. The pin F34 is coupled to the pin R33 through the bypass line BP34' to transmit the start pulse signal STV2. In the embodiment, the pins R31 to R34 of the panel C1 are sequentially coupled to the pins F41 to F44 of the panel D1 through the cable 241 respectively.

In the panel D1, the pin F41 is coupled to the pin R44 through the bypass line BP41' to transmit the start pulse signal STV4. The pin F42 is coupled to the pin R41 through the bypass line BP42' to transmit the start pulse signal STV1. The pin F43 is coupled to the pin R42 through the bypass line BP43' to transmit the start pulse signal STV2. The pin F44 is coupled to the pin R43 through the bypass line BP44' to transmit the start pulse signal STV3.

In other words, the panels A1 to D1 of the embodiment of FIG. 3B achieve the effect of transmitting the start pulse signals STV1 to STV4 through an interleaving arrangement of the bypass lines inside the panels A1 to D1 on the signal transmission paths for transmitting the start pulse signals STV1 to STV4, which is different from the embodiment of FIG. 3A where the panels A1 to D1 achieve the effect of transmitting the start pulse signals STV1 to STV4 through an interleaving arrangement of external circuits of the panels A1 to D1. Therefore, the panels A1 to D1 of the embodiment may have the splicing display effect as that in the embodiment of FIG. 3A, or may also achieve the effect of saving a cable space.

Figure 4A:
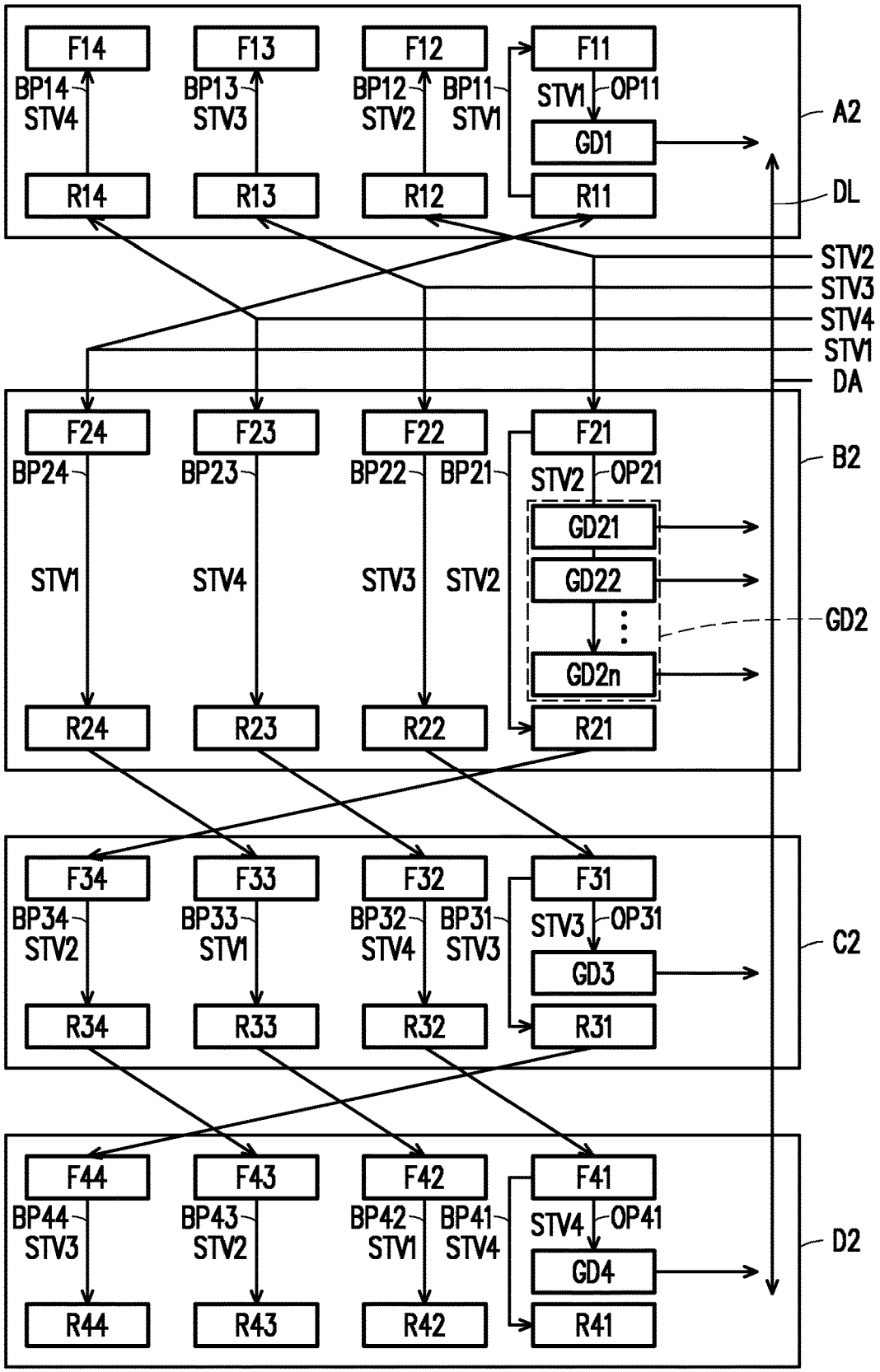
FIG. 4A is a circuit schematic diagram of a plurality of panels spliced into a same column according to a third embodiment of the disclosure.
Figure 5A:
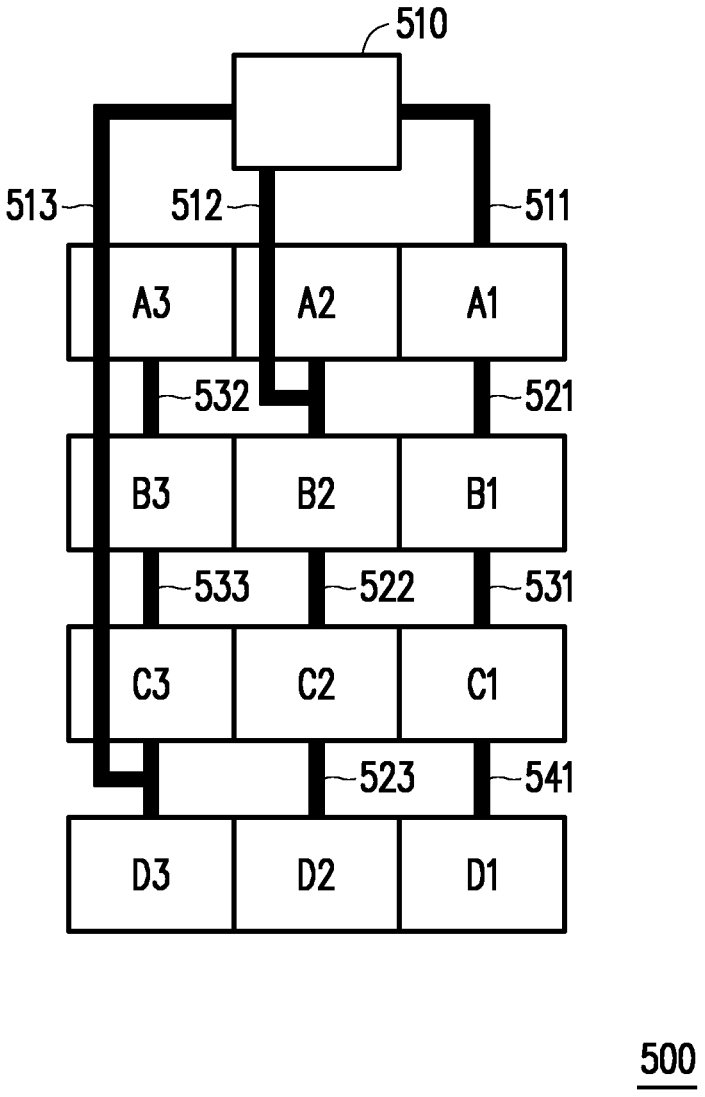
FIG. 5A is a schematic diagram of a splicing display device according to the third or a fourth embodiment of the disclosure.

FIG. 4A is a circuit schematic diagram of a plurality of panels spliced into a same column according to a third embodiment of the disclosure. FIG. 5A is a schematic diagram of a splicing display device according to the third or a fourth embodiment of the disclosure. Referring to FIG. 4A and FIG. 5A, the panels A2 to D2 in the same column of FIG. 5A will be taken as an example for description. It should be noted that cables 512 and 513 of FIG. 5A may also be coupled between the panels. For example, the flat cable 512 may be branched to be coupled between the panels A2 and B2. Therefore, referring to FIG. 4A, in this embodiment, the panel A2 includes pins F11 to F14, R11 to R14, a multi-stage gate driving unit GD1, bypass lines BP11 to BP14, and a signal line OP11. The panel B2 includes pins F21 to F24, R21 to R24, a multi-stage gate driving unit GD2, bypass lines BP21 to BP24, and a signal line OP21. The panel C2 includes pins F31 to F34, R31 to R34, a multi-stage gate driving unit GD3, bypass lines BP31 to BP34, and a signal line OP31. The panel D2 includes pins F41 to F44, R41 to R44, a multi-stage gate driving unit GD4, bypass lines BP41 to BP44, and a signal line OP41. In addition, the panels A2 to D2 further include the data line DL and other pins to respectively receive the data signal DA provided by the control board 210.

It should be noted that the hardware features of the panels A2 to D2 of the embodiment are the same or similar to those of the panels A1 to D1 of FIG. 3A, so that details thereof are not repeated. A coupling method of the bypass lines BP11 to BP14, BP21 to BP24, BP31 to BP34, and BP41 to BP44 in the panels A2 to D2 of the embodiment is similar to that of the bypass lines in the panels A1 to D1 of FIG. 3A, and the difference is only in a different transmission direction of the start pulse signals STV1 to STV4. In the embodiment, the start pulse signals STV1 to STV4 and the data signal DA may be transmitted to the panel A2 and the panel B2 through the cable coupled between the panel A2 and the panel B2.

In the embodiment, the pins R11 to R14 of the panel A2 may respectively receive the start pulse signals STV1 to STV4 from the cable, and the panel A2 also receives the data signal DA from the cable. The pins R11 to R14 of the panel A2 are respectively coupled to the pins F11 to F14 through the bypass lines BP11 to BP14. The pin F11 of the panel A2 is also coupled to the multi-stage gate driving unit GD1, i.e., in the panel A2, the start pulse signal STV1 is first received by the pin R11, and is then transmitted to the multi-stage gate driving unit GD1 through the pin F11. In the embodiment, the pins F21 to F24 of the panel B2 may respectively receive the start pulse signals STV2 to STV4 and STV1 from the cable, and the panel B2 also receives the data signal DA from the cable. The pins F21 to F24 of the panel B1 are respectively coupled to the pins R21 to R24 through the bypass lines BP21 to BP24. The pin F21 of the panel B2 is further coupled to the multi-stage gate driving unit GD2. The multi-stage gate driving unit GD2 may include a plurality of gate driving units GD21 to GD2*n*. In other words, the start pulse signals STV1 to STV4 and the data signal DA of the embodiment may be input through the cable between the panel A2 and the panel B2 to achieve a similar display driving function. In addition, the signal transmission manner of the panel C2 and the panel D2 of the embodiment is similar to that of the panel C1 and the panel D1 in the embodiment of FIG. 3A, so that details thereof are not repeated.

In addition, in other embodiments of the disclosure, the start pulse signals STV1 to STV4 and the data signal DA may also be separately transmitted from another plurality of wires and another plurality of pins on the panel A2 or the panel B2. Namely, the separate transmission lines of the signals are located in the panel, rather than being achieved by branching the cable. For example, the panel A2 may further include another plurality of pins to receive the start pulse signals STV1 to STV4 and the data signal DA. On one hand, the another plurality of wires are used to connect the pins R11 to R14 of the panel A2, and on the other hand, the panel B2 is coupled to the another plurality of pins of the panel A2 through the cable.

Figure 4B:
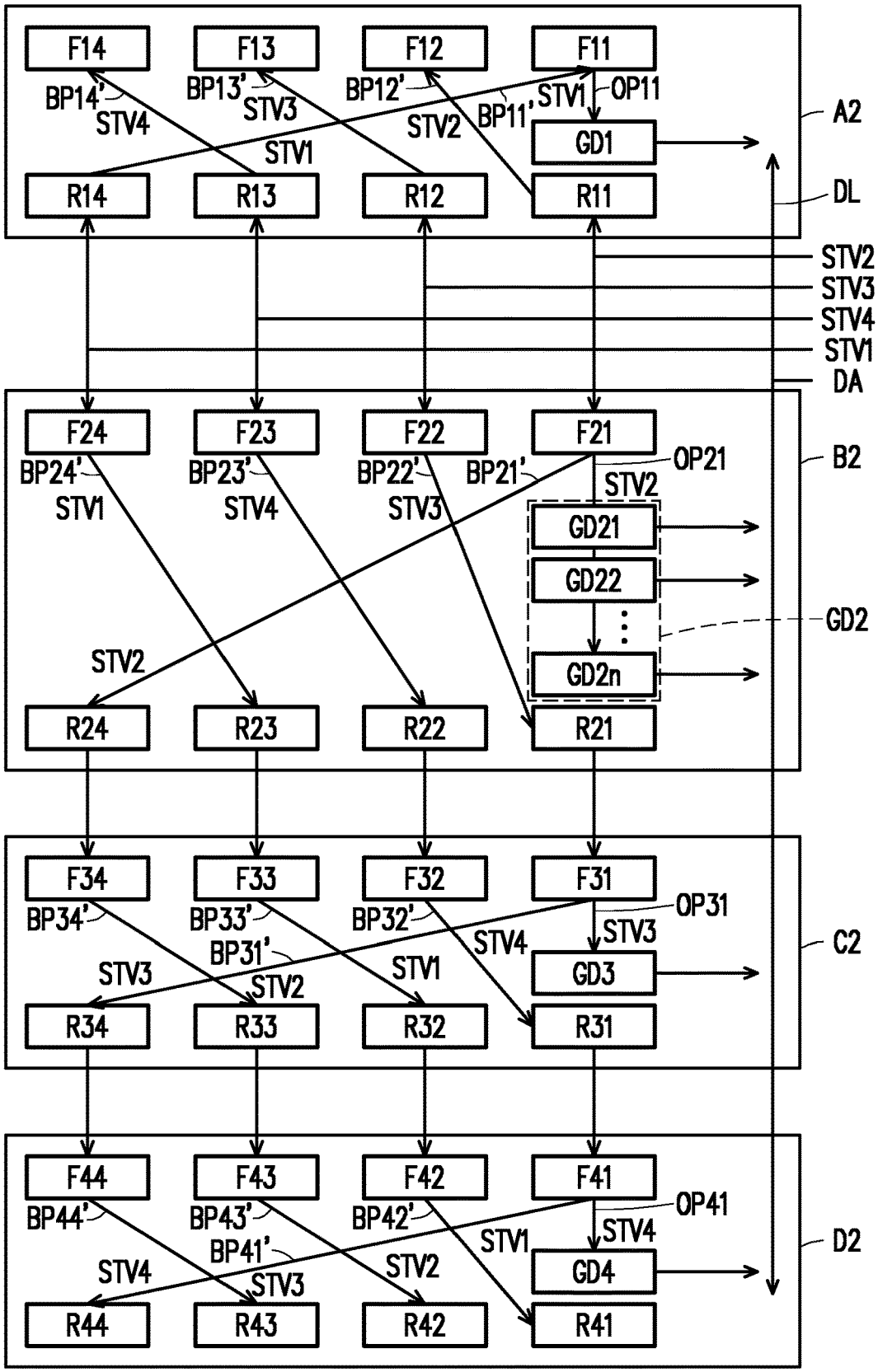
FIG. 4B is a circuit schematic diagram of a plurality of panels spliced into a same column according to the fourth embodiment of the disclosure.

FIG. 4B is a circuit schematic diagram of a plurality of panels spliced into the same column according to the fourth embodiment of the disclosure. Referring to FIG. 4B and FIG. 5A, the panels A2 to D2 in the same column of FIG.

5A will be taken as an example for description. It should be noted that the cable 512 of FIG. 5A may also be coupled between the panel A2 and the panel B2. Referring to FIG. 4B, in the embodiment, the panel A2 includes pins F11 to F14, R11 to R14, a multi-stage gate driving unit GD1, bypass lines BP11 to BP14, and a signal line OP11. The panel B2 includes pins F21 to F24, R21 to R24, a multi-stage gate driving unit GD2, bypass lines BP21' to BP24', and a signal line OP21. The panel C2 includes pins F31 to F34, R31 to R34, a multi-stage gate driving unit GD3, bypass lines BP31' to BP34', and a signal line OP31. The panel D2 includes pins F41 to F44, R41 to R44, a multi-stage gate driving unit GD4, bypass lines BP41' to BP44', and a signal line OP41. Moreover, the panels A2 to D2 further include the data line DL and other pins to respectively receive the data signal DA provided by the control board 210.

It should be noted that the hardware features of the panels A2 to D2 of the embodiment and the coupling method of the bypass lines BP11 to BP14, BP21 to BP24, BP31 to BP34, and BP41 to BP44 are similar to that of the panels A1 to D1 of FIG. 3B, and the difference is only in a different transmission direction of the start pulse signals STV1 to STV4. In the embodiment, the start pulse signals STV1 to STV4 and the data signal DA may be separately transmitted to the panel A2 and the panel B2 through the cable coupled between the panel A2 and the panel B2.

In the embodiment, the pins R11 to R14 of the panel A2 may respectively receive the start pulse signals STV1 to STV4 from the cable, and the panel A2 also receives the data signal DA from the cable. The pins R11 to R14 of the panel A2 are respectively coupled to the pins F12 to F14 and the pin F11 through the bypass lines BP11 to BP14 in the manner shown in FIG. 3B. The pin F11 of the panel A2 is further coupled to the multi-stage gate driving unit GD1. In the embodiment, the pins F21 to F24 of the panel B2 may respectively receive the start pulse signals STV2 to STV4 and STV1 from the cable, and the panel B2 also receives the data signal DA from the cable. The pins F21 to F24 of the panel B2 are respectively coupled to the pins R24', R21' to R23' through the bypass lines BP21' to BP24'. The pin F21 of the panel B2 is further coupled to the multi-stage gate driving unit GD2. The multi-stage gate driving unit GD2 may include a plurality of gate driving units GD21 to GD2*n*. In other words, the start pulse signals STV1 to STV4 and the data signal DA of the embodiment may be input from the cable between the panel A2 and the panel B2 to achieve a similar display driving function. In addition, the signal transmission manner of the panel C2 and the panel D2 of the embodiment is similar to that of the panel C1 and the panel D1 in the embodiment of FIG. 3B, so that details thereof are not repeated.

In addition, in some other embodiments of the disclosure, the start pulse signals STV1 to STV4 and the data signal DA may also be separately transmitted from another plurality of wires and another plurality of pins on the panel A2 or the panel B2. Namely, the separate transmission lines of the signals are located in the panel, rather than being achieved by branching the cable. For example, the panel A2 may further include another plurality of pins to receive the start pulse signals STV1 to STV4 and the data signal DA. On one hand, the another plurality of wires are used to connect the pins R11 to R14 of the panel A2, and on the other hand, the panel B2 is coupled to the another plurality of pins of the panel A2 through the cable.

FIG. 5A is a schematic diagram of a splicing display device according to the third or fourth embodiment of the disclosure. Referring to FIG. 5A, a splicing display device 500 may include a plurality of panels A1 to A3, B1 to B3, C1 to C3, D1 to D3 arranged in an array, but the number of the panels in the disclosure is not limited thereto. A difference from the embodiment in FIG. 2 is that the arrangement of the cables in the embodiment may be, for example, the arrangement of the cables in the above-mentioned FIG. 4A or FIG. 4B. In the embodiment, the panels A1, B1, C1, and D1 are spliced in a same column. The panels A2, B2, C2, and D2 are spliced in another column. The panels A3, B3, C3, and D3 are spliced in still another column. A control board 510 may be coupled to the panels A1, A2, B2, C3, D3 through the cables 511 to 513 to provide a plurality of start pulse signals for driving the panels A1 to A3, B1 to B3, C1 to C3, D1 to D3 and provide the data signal DA to the panels A1, B2, C2, C3, and D3. In the embodiment, the start pulse signals and the data signal DA may be separately transmitted to the panel A2 and the panel B2 through the cable coupled between the panel A2 and the panel B2, and separately transmitted to the panel C3 and the panel D3 through the cable coupled between the panel C3 and the panel D3. In this regard, the splicing display device 500 may perform display driving based on the start pulse signals and the data signal DA corresponding to the panels A1 to D3.

In the embodiment, the panels A1, B2, and C3 are respectively coupled to the panels B1, C2, and B3 through cables 521, 522, and 533. The panels A1, B2, and C3 may respectively transmit the plurality of start pulse signals for driving the panels B1, C2, B3 and the data signal DA to the panels B1, C2, B3 through a plurality of bypass lines in the panels A1, B2, and C3 and the cables 521, 522, 533. In this regard, the panels B1, C2, and B3 may respectively perform display driving based on the corresponding start pulse signals and the data signal DA.

In the embodiment, the panels C1 and B3 are respectively coupled to the panels D1 and A3 through cables 541 and 532. The panels C1 and B3 may respectively transmit the plurality of start pulse signals for driving the panels D1 and A3 and the data signal DA to the panels D1 and A3 through a plurality of bypass lines in the panels C1 and B3 and the cables 541 and 532. In this regard, the panels D1 and A3 may respectively perform display driving based on the corresponding start pulse signals and the data signal DA.

It should be noted that FIG. 5A is only an example. The cable arrangement of the splicing display device 500 of the embodiment may have multiple variations according to different panel driving sequences or other splicing designs.

Figure 5B:
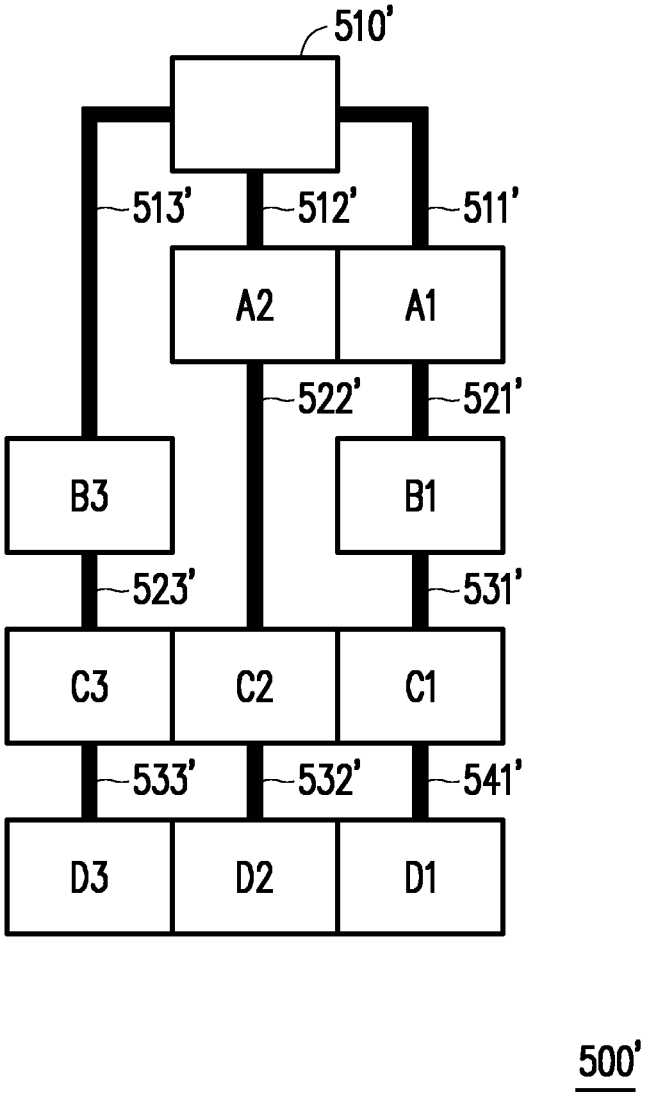
FIG. 5B is a schematic diagram of a splicing display device according to a fifth embodiment of the disclosure.

FIG. 5B is a schematic diagram of a splicing display device according to a fifth embodiment of the disclosure. Referring to FIG. 5B, a splicing display device 500' may include a plurality of panels A1 to A2, B1, B3, C1 to C3, D1 to D3 arranged in an array, but the number of the panels in the disclosure is not limited thereto. Compared to FIG. 2, FIG. 5B is lack of the panels A2 and B2, so that the number of the panels in the embodiment is different from that of FIG. 2. The cable arrangement of the embodiment may, for example, adopt the above-mentioned cable arrangement of FIG. 3A or FIG. 3B. In the embodiment, the panels A1, B1, C1, and D1 are spliced in the same column. The panels A2, C2, D2 are spliced in another column. The panels B3, C3, and D3 are spliced in still another column. A control board 510' may be coupled to the panels A1, A2, and B3 through cables 511' to 513' to provide a plurality of corresponding start pulses for driving the panels A1 to A2, B1, B3, C1 to C3, and D1 to D3 and the data signal DA to the panels A1, A2, B3. In this regard, the panels A1, A2, and B3 may respectively perform display driving based on the corresponding start pulse signals and the data signal DA.

In the embodiment, the panels A1, A2, and B3 are respectively coupled to the panels B1, C2, and C3 through cables 521', 522', and 523'. The panels A1, A2, and B3 may respectively transmit the plurality of start pulse signals for driving the panels B1, C1 to C3, and D1 to D3 and the data signal DA to the panels B1, C2, C3 through a plurality of bypass lines in the panels A1, A2, and B3 and the cables 521', 522', and 523'. In this regard, the panels B1, C2, and C3 may respectively perform display driving based on the corresponding start pulse signals and the data signal DA.

In the embodiment, the panels B1, C2, and C3 are respectively coupled to the panels C1, D2, and D3 through cables 531', 532', and 533'. The panels B1, C2, and C3 may respectively transmit the plurality of start pulse signals for driving the panels C1, D1 to D3 and the data signal DA to the panels C1, D2, D3 through a plurality of bypass lines in the panels B1, C2, and C3 and the cables 531', 532', and 533'. In this regard, the panels C1, D2, and D3 may respectively perform display driving based on the corresponding start pulse signals and the data signal DA.

In the embodiment, the panel C1 is coupled to the panel D1 through a cable 541'. The panel C1 may transmit the plurality of start pulse signals for driving the panel D1 and the data signal DA to the panel D1 through a plurality of bypass lines in the panel C1 and the cable 541'. In this regard, the panel D1 may respectively perform display driving based on the corresponding start pulse signals and the data signal DA.

Therefore, the panel cable arrangement of the splicing display device 500' of the embodiment may be arbitrarily adjusted according to different splicing requirements, thereby providing a variety of device appearances or splicing display effects. In addition, the disclosure may also have a cost-saving effect. Since each panel of the splicing display device 500' has the similar signal transmission path inside, a variety of appearance changes of the splicing display device may also be achieved by using uniformly produced panels, without the need of producing different panels for special splicing appearances.

Figure 6A:
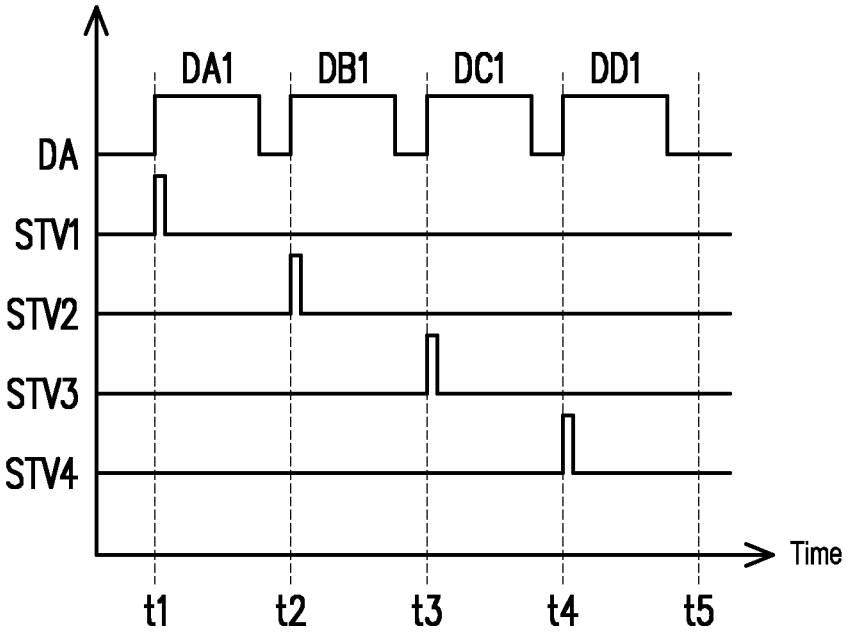
FIG. 6A is a signal timing diagram of start pulse signals and a data signal according to an embodiment of the disclosure.

FIG. 6A is a signal timing diagram of the start pulse signals and the data signal according to an embodiment of the disclosure. Referring to FIG. 2 and FIG. 6A, taking the panels A1, B1, C1, and D1 as an example, the control board 210 may output the start pulse signals STV1 to STV4 and the data signal DA to the panels A1, B1, C1, D1. The data signal DA may include data waveforms DA1, DB1, DC1, and DD1. The data waveforms DA1, DB1, DC1, and DD1 are between time t1 and time t5. The data waveforms DA1, DB1, DC1, and DD1 are respectively used to drive the panels A1, B1, C1, and D1. In the embodiment, start pulses in the start pulse signals STV1 to STV4 may be sequentially synchronized with the data waveforms DA1, DB1, DC1, and DD1 of the data signal DA, respectively. To be specific, the start pulse of the start pulse signal STV1 occurs at time t1, so that the panel A1 may simultaneously receive the start pulse of the start pulse signal STV1 and the data waveform DA1 of the data signal DA at time t1. The panel A1 may perform display driving according to the start pulse of the start pulse signal STV1 and the data waveform DA1 of the data signal DA at time t1. In the embodiment, the start pulse of the start pulse signal STV2 occurs at time t2, so that the panel B1 may simultaneously receive the start pulse of the start pulse signal STV2 and the data waveform DB1 of the data signal DA at time t2. The panel B1 may perform display driving according to the start pulse of the start pulse signal STV2 and the data waveform DB1 of the data signal DA at time t2. In the embodiment, the start pulse of the start pulse signal STV3 occurs at time t3, so that the panel C1 may simultaneously receive the start pulse of the start pulse signal STV3 and the data waveform DC1 of the data signal DA at time t3. The panel C1 may perform display driving according to the start pulse of the start pulse signal STV3 and the data waveform DC1 of the data signal DA at time t3. In the embodiment, the start pulse of the start pulse signal STV4 occurs at time t4, so that the panel D1 may simultaneously receive the start pulse of the start pulse signal STV4 and the data waveform DD1 of the data signal DA at time t4. The panel D1 may perform display driving according to the start pulse of the start pulse signal STV4 and the data waveform DD1 of the data signal DA at time t4. Therefore, the panels A1 to D1 of the embodiment may be sequentially lit.

Figure 6B:
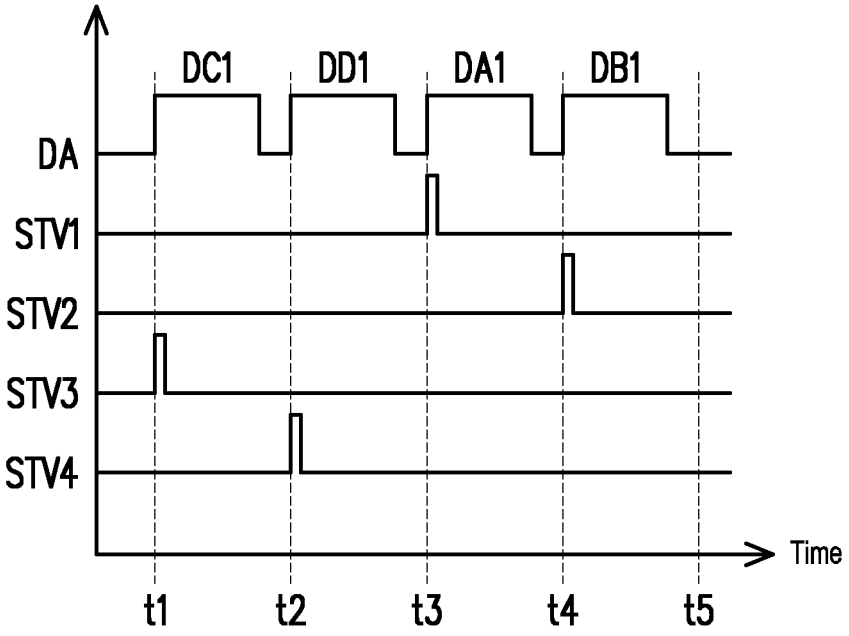
FIG. 6B is a signal timing diagram of start pulse signals and a data signal according to another embodiment of the disclosure.

FIG. 6B is a signal timing diagram of the start pulse signals and the data signal according to another embodiment of the disclosure. Referring to FIG. 2 and FIG. 6B, compared to FIG. 6A, the start pulses of the start pulse signals and the data waveforms DA1, DB1, DC1, and DD1 of the data signal of the embodiment may be adjusted according to different panel lighting sequences. Specifically, the lighting sequence may be the panel C1, the panel D1, the panel A1, and the panel B1. Therefore, in the embodiment, the start pulse of the start pulse signal STV3 occurs at time t1, so that the panel C1 may simultaneously receive the start pulse of the start pulse signal STV3 and the data waveform DC1 of the data signal DA at time t1. The panel C1 may perform display driving according to the start pulse of the start pulse signal STV3 and the data waveform DC1 of the data signal DA at time t1. In the embodiment, the start pulse of the start pulse signal STV4 occurs at time t2, so that the panel D1 may simultaneously receive the start pulse of the start pulse signal STV4 and the data waveform DD1 of the data signal DA at time t2. The panel D1 may perform display driving according to the start pulse of the start pulse signal STV4 and the data waveform DD1 of the data signal DA at time t2. In the embodiment, the start pulse of the start pulse signal STV1 occurs at time t3, so that the panel A1 may simultaneously receive the start pulse of the start pulse signal STV1 and the data waveform DA1 of the data signal DA at time t3. The panel A1 may perform display driving according to the start pulse of the start pulse signal STV1 and the data waveform DA1 of the data signal DA at time t3. In the embodiment, the start pulse of the start pulse signal STV2 occurs at time t4, so that the panel B1 may simultaneously receive the start pulse of the start pulse signal STV2 and the data waveform DB1 of the data signal DA at time t4. The panel B1 may perform display driving according to the start pulse of the start pulse signal STV2 and the data waveform DB1 of the data signal DA at time t4. Therefore, the panels C1, D1, A1, and B1 of the embodiment may be sequentially lit.

Figure 6C:
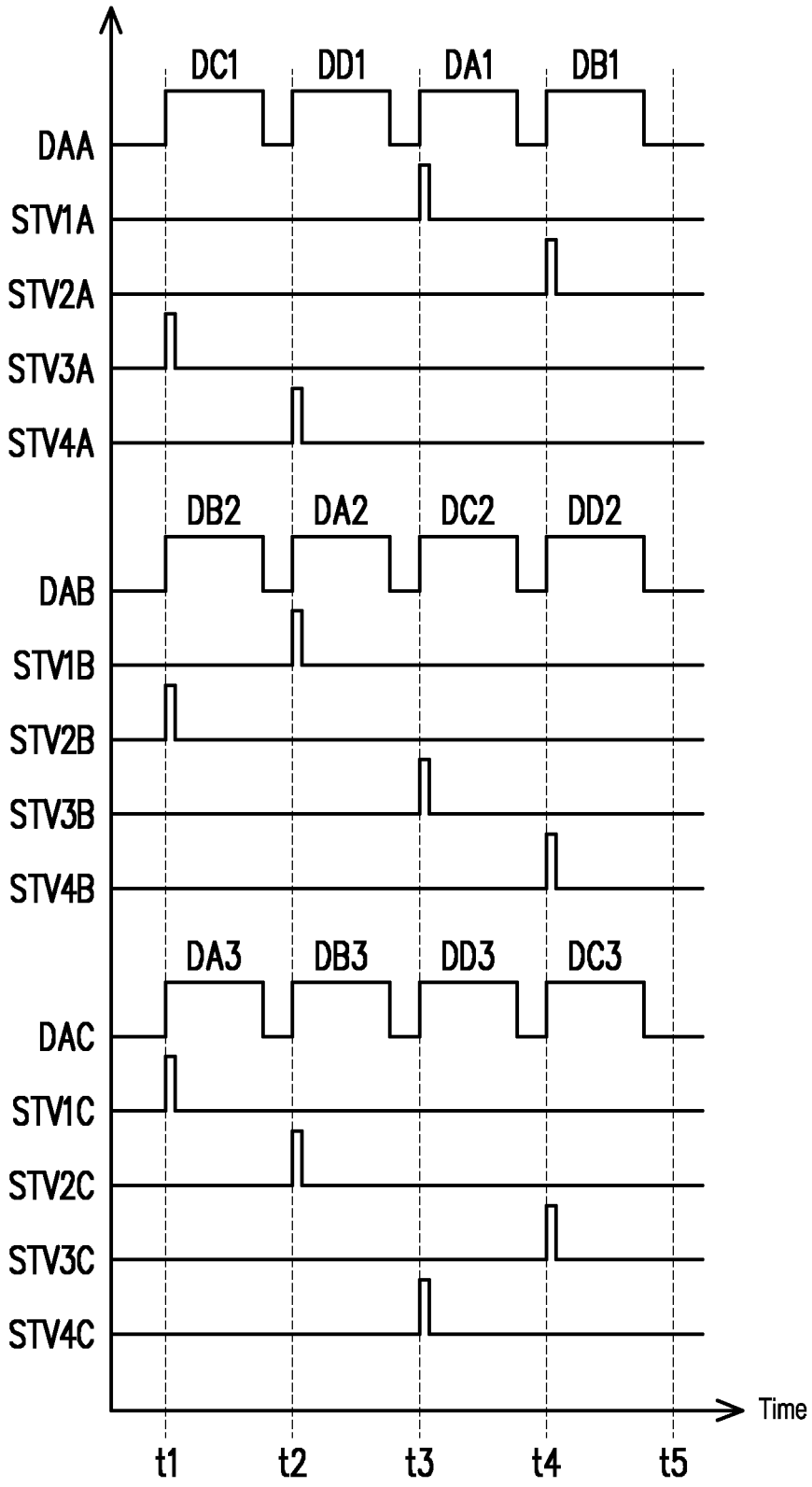
FIG. 6C is a signal timing diagram of start pulse signals and a data signal according to another embodiment of the disclosure.

FIG. 6C is a signal timing diagram of the start pulse signals and the data signal according to another embodiment of the disclosure. Referring to FIG. 2 and FIG. 6C, taking lighting of all panels as an example, the control board 210 may output start pulse signals STV1A to STV4A and a data signals DAA to the panels A1, B1, C1, D1. The control board 210 may output tart pulse signals STV1B to STV4B and a data signal DAB to the panels A2, B2, C2, and D2. The control board 210 may output start pulse signals STV1C to STV4C and a data signal DAC to the panels A3, B3, C3, and D3. As described in FIG. 6B, a lighting sequence of the panels in each column may be dynamically adjusted. In the embodiment, according to the start pulses of the start pulse signals STV3A, STV2B, STV1C and the data waveform DC1 of the data signal DAA, the data waveform DB2 of the data signal DAB, and the data waveform DA3 of the data signal DAC, the panel C1 of the first column corresponding to the start pulse signal STV3A, the panel B2 of the second column corresponding to the start pulse signal STV2B, and the panel A3 of the third column corresponding to the start pulse signal STV1C may be lit at time t1. In the embodiment, according to the start pulses of the start pulse signals STV4A, STV1B, STV2C and the data waveform DD1 of the data signal DAA, the data waveform DA2 of the data signal DAB, and the data waveform DB3 of the data signal DAC, the panel D1 of the first column corresponding to the start pulse signal STV4A, the panel A2 of the second column corresponding to the start pulse signal STV1B, and the panel B3 of the third column corresponding to the start pulse signal STV2C may be lit at time t2. In the embodiment, according to the start pulses of the start pulse signals STV1A, STV3B, STV4C and the data waveform DA1 of the data signal DAA, the data waveform DC2 of the data signal DAB, and the data waveform DD3 of the data signal DAC, the panel A1 of the first column corresponding to the start pulse signal STV1A, the panel C2 of the second column corresponding to the start pulse signal STV3B, and the panel D3 of the third column corresponding to the start pulse signal STV4C may be lit at time t3. In the embodiment, according to the start pulses of the start pulse signals STV2A, STV4B, STV3C and the data waveform DB1 of the data signal DAA, the data waveform DD2 of the data signal DAB, and the data waveform DC3 of the data signal DAC, the panel B1 of the first column corresponding to the start pulse signal STV2A, the panel D2 of the second column corresponding to the start pulse signal STV4B, and the panel C3 of the third column corresponding to the start pulse signal STV3C may be lit at time t4. Therefore, in the embodiment, the plurality of panels of different columns may be lit according to different sequences, respectively. It should be noted that the waveform sequences of FIG. 6A to FIG. 6C are only an example, and the disclosure is not limited thereto.

Figure 7A:
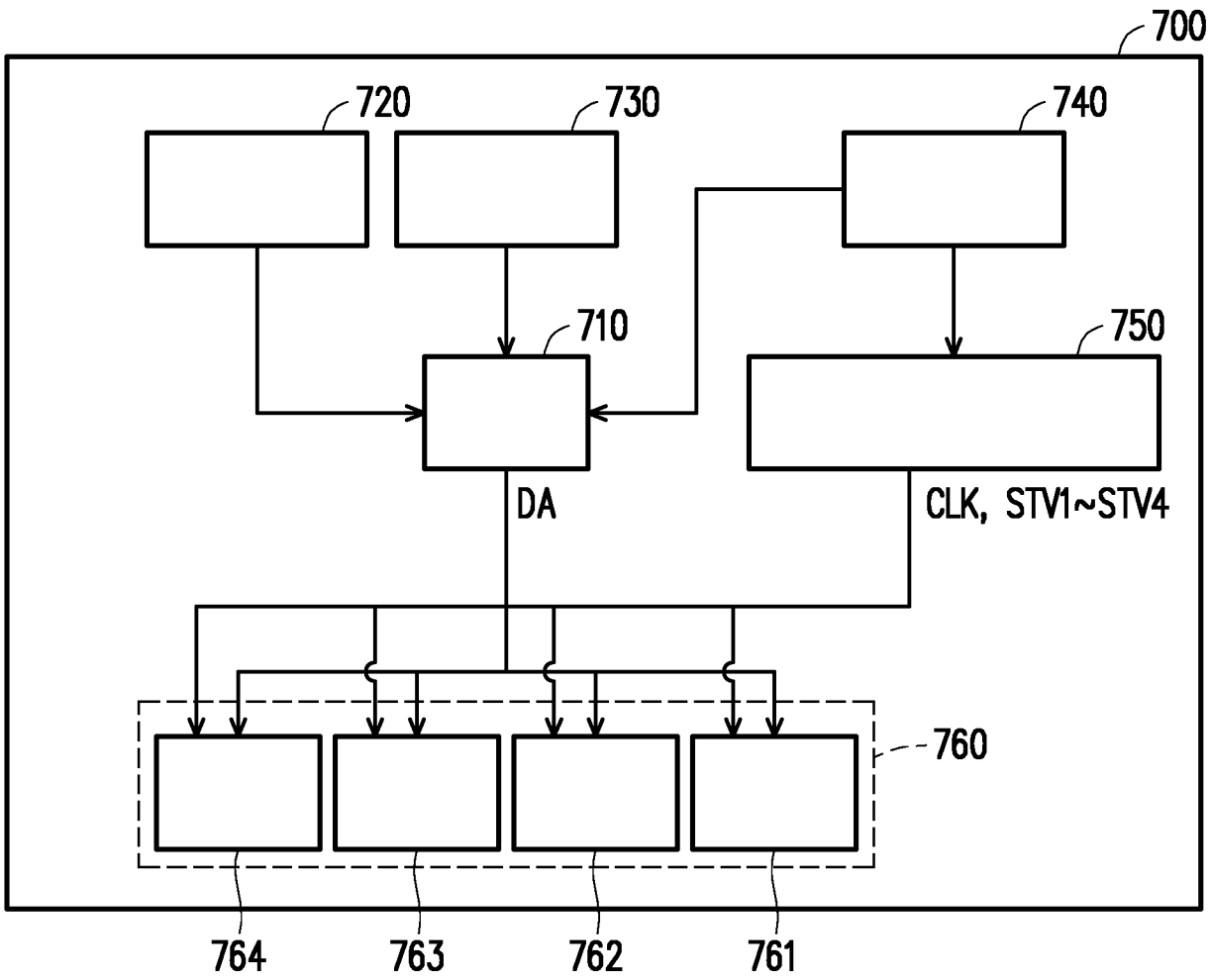
FIG. 7A is a circuit schematic diagram of a control board according to an embodiment of the disclosure.

FIG. 7A is a circuit schematic diagram of a control board according to an embodiment of the disclosure. Referring to FIG. 7A, the control board of each embodiment of the disclosure may be implemented as a circuit structure shown in FIG. 7A. In the embodiment, a control board 700 includes a source driver 710, a gamma circuit 720, a pulse width adjustment circuit 730, a timing control circuit 740, a voltage converter 750, and an output terminal 760. The output terminal 760 may include, but is not limited to, a plurality of pins 761 to 764. In the embodiment, the source driver 710 is coupled to the gamma circuit 720, the pulse width adjustment circuit 730, the timing control circuit 740, and the pins 761 to 764. The gamma circuit 720 may provide a gamma signal to the source driver 710, where different potentials of the gamma signal may cause the source driver 710 to correspondingly output different image gray levels. The pulse width adjustment circuit 730 may provide a pulse modulation signal to the source driver 710. To be more specific, the pulse width adjustment circuit 730 may convert an input voltage (for example, 12 volts) into a voltage required by the source driver 710 (for example, 3.3 volts or 16 volts). The timing control circuit 740 may provide a low-voltage differential signal to the source driver 710 to enable the source driver 710 to output image data to be displayed, and provide a clock signal CLK and the start pulse signals STV1 to STV4 to the voltage converter 750. The voltage converter 750 is coupled to the timing control circuit 740 and the output terminal 760 for boosting the clock signal CLK and the start pulse signals STV1 to STV4, and transmits the boosted clock signal CLK and the start pulse signals STV1 to STV4 to the pins 761 to 764 of the output terminal 760, such that the clock signal CLK and the start pulse signals STV1 to STV4 are transmitted to a plurality of panels through the pins 761 to 764. The source driver 710 may generate and provide the data signal DA to the pins 761 to 764 of the output terminal 760 according to the gamma signal, the low-voltage differential signal and the pulse modulation signal. Therefore, the control board 700 of the embodiment may output the data signal DA with a uniform voltage specification to a plurality of panels through the source driver 710, and may output the clock signal CLK with a uniform voltage specification and the start pulse signals STV1 to STV4 to the plurality of panels through the voltage converter 750. Therefore, the splicing display device applying the control board 700 of the embodiment may display spliced display images with smaller display brightness differences.

Figure 7B:
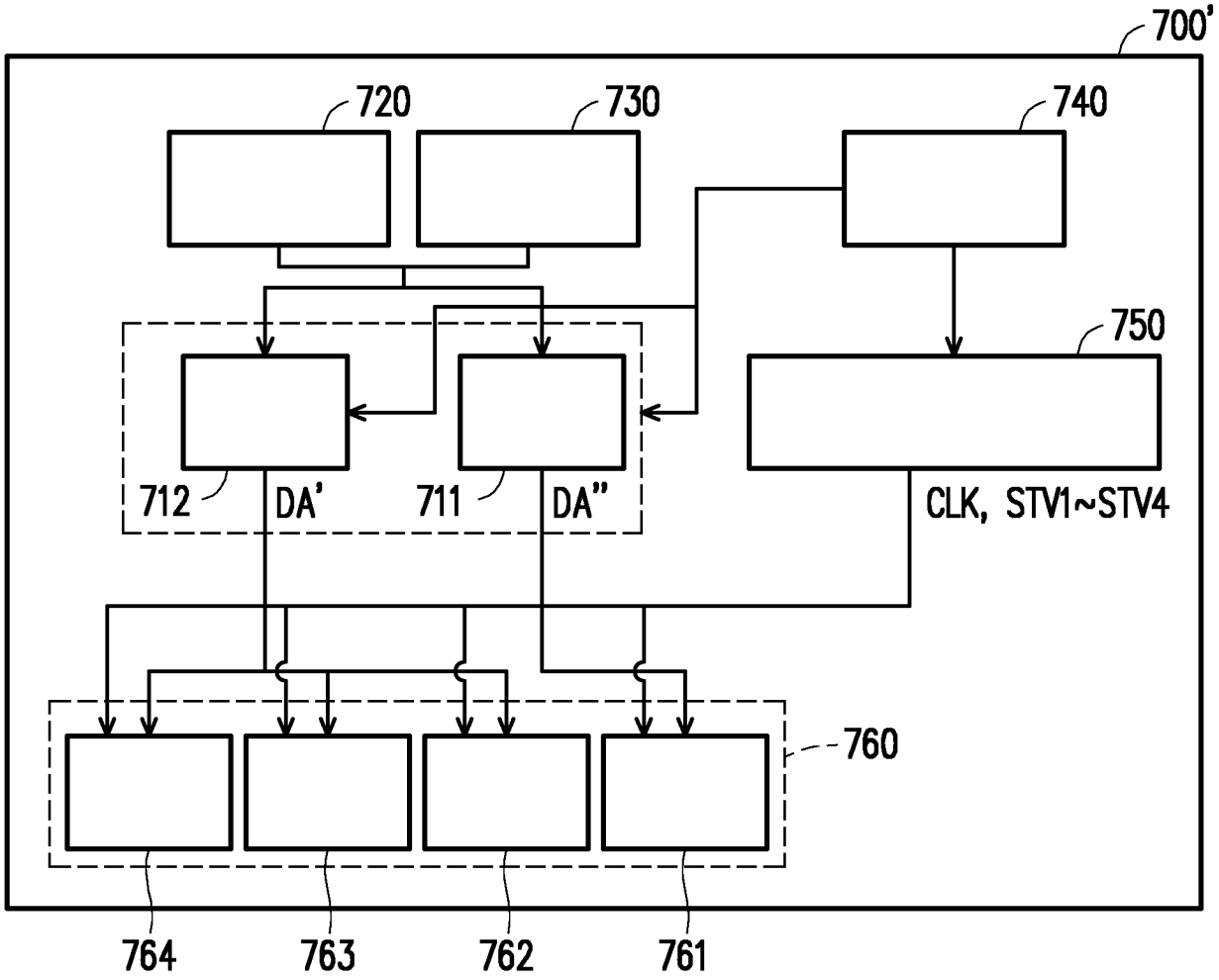
FIG. 7B is a circuit schematic diagram of a control board according to another embodiment of the disclosure.

FIG. 7B is a circuit schematic diagram of a control board according to another embodiment of the disclosure. Referring to FIG. 7B, the control board of each embodiment of the disclosure may be implemented by a circuit structure shown in FIG. 7B. In the embodiment, a control board 700' includes source drivers 711, 712, a gamma circuit 720, a pulse width adjustment circuit 730, a timing control circuit 740, a voltage converter 750, and an output terminal 760. The output terminal 760 may include, but is not limited to, a plurality of pins 761 to 764. Different from the embodiment in FIG. 7A, in the embodiment, two source drivers 711 and 712 (but the number of the source drivers is not limited to two) may be configured. The source driver 711 may generate and provide a data signal DA' to the pins 761 to 763 of the output terminal 760 according to the gamma signal, the low-voltage differential signal and the pulse modulation signal. The source driver 712 may generate and provide a data signal DA" to the pin 764 of the output terminal 760 according to the gamma signal, the low-voltage differential signal and the pulse modulation signal. Since the source driver 711 and the source driver 712 generate and provide the data signal DA' and the data signal DA" according to the same gamma signal, low-voltage differential signal, and pulse modulation signal, the source driver 711 and the source driver 712 may output the data signal DA' and the data signal DA" with a uniform voltage specification to a plurality of panels. Therefore, the splicing display device applying the control board 700' of the embodiment may also display spliced display images with smaller display brightness differences. It should be noted that the circuit structures of the control boards 700 and 700' in FIG. 7A and FIG. 7B are only examples, and the disclosure is not limited thereto.

In summary, the splicing display device of the disclosure may provide multiple start pulse signals and the data signal through the same control board, so as to present splicing display images with small display brightness differences. In addition, the splicing display device of the disclosure may efficiently transmit multiple start pulse signals and the data signal to the adjacent panels through a special pin design of the panels, so as to effectively reduce an installation space of the cables. Moreover, since each panel of the splicing display device has the same or similar signal transmission path inside, a variety of appearance changes of the splicing display device may be achieved by using uniformly produced panels, without the need of producing different panels for special splicing appearances.

It will be apparent to those skilled in the art that various modifications and variations can be made to the disclosed embodiments without departing from the scope or spirit of the invention. In view of the foregoing, it is intended that the invention covers modifications and variations provided they fall within the scope of the following claims and their equivalents.

What is claimed is:

1. A splicing display device, comprising:

a control board, comprising an output terminal;

a first panel, comprising a first gate driving unit, a first signal line, a first bypass line, and a second bypass line, and coupled to the output terminal; and a second panel, comprising a second gate driving unit and coupled to the first panel, wherein the first panel and the second panel are disposed in a same column, wherein the control board provides a first signal and a second signal to the first panel through the output terminal, and the first signal is transmitted to the first gate driving unit through the first signal line and is transmitted to the second panel through the first bypass line, wherein the second signal is transmitted to the second gate driving unit through the second bypass line.

2. The splicing display device as claimed in claim 1, wherein the first panel further comprises:

a first pin, disposed on a first side of the first panel; and a second pin, disposed on the first side of the first panel, wherein the first bypass line is coupled to the first pin, and the second bypass line is coupled to the second pin.

3. The splicing display device as claimed in claim 2, wherein the first panel further comprises:

a third pin, disposed on a second side of the first panel, wherein the second side is different from the first side;

a fourth pin, disposed on the second side of the first panel; and a fifth pin, disposed on the second side of the first panel, wherein the third pin is disposed to be closest to the first pin, and the second pin is closest to the fourth pin, wherein the first bypass line is coupled to the third pin, and the second bypass line is coupled to the fourth pin.

4. The splicing display device as claimed in claim 3, wherein the second panel further comprises:

a sixth pin, disposed on a first side of the second panel, wherein the first side of the second panel is disposed to be closest to the second side of the first panel;

a seventh pin, disposed on the first side of the second panel; and an eighth pin, disposed on the first side of the second panel, wherein the sixth pin is disposed to be closest to the third pin, and the seventh pin is disposed to be closest to the fourth pin, wherein the fourth pin is coupled to the sixth pin, and the third pin is coupled to the eighth pin.

5. The splicing display device as claimed in claim 2, wherein the first panel further comprises:

a third pin, disposed on a second side of the first panel, wherein the second side is opposite to the first side;

a fourth pin, disposed on the second side of the first panel; and a fifth pin, disposed on the second side of the first panel, wherein the third pin is disposed to be closest to the first pin, and the second pin is closest to the fourth pin, wherein the first bypass line is coupled to the fifth pin, and the second bypass line is coupled to the third pin.

6. The splicing display device as claimed in claim 5, wherein the second panel further comprises:

a sixth pin, disposed on a first side of the second panel, wherein the first side of the second panel is disposed to be closest to the second side of the first panel;

a seventh pin, disposed on the first side of the second panel; and an eighth pin, disposed on the first side of the second panel, wherein the sixth pin is disposed to be closest to the third pin, and the seventh pin is disposed to be closest to the fourth pin, wherein the third pin is coupled to the sixth pin, and the fourth pin is coupled to the eighth pin.

7. The splicing display device as claimed in claim 1, wherein the first panel further comprises another plurality of first gate driving units, and the another plurality of first gate driving units are coupled to the first gate driving unit.

8. The splicing display device as claimed in claim 7, wherein the first panel further comprises a plurality of gate lines, and the first gate driving unit generates a scan signal and an operation signal according to the first signal, and transmits the same to at least one of the another plurality of first gate driving units.

9. The splicing display device as claimed in claim 8, wherein the another plurality of first gate driving units respectively receive the scan signal and the operation signal provided by a gate driving unit of a previous stage, and respectively generate a corresponding scan signal.

10. The splicing display device as claimed in claim 1, wherein the second panel further comprises another plurality of second gate driving units, and the another plurality of second gate driving units are coupled to the second gate driving unit.

11. The splicing display device as claimed in claim 10, wherein the second panel further comprises another plurality of gate lines, and the second gate driving unit generates another scan signal and another operation signal according to the second signal, and transmits the same to at least one of the another plurality of second gate driving units.

12. The splicing display device as claimed in claim 11, wherein the another plurality of second gate driving units respectively receive the another scan signal and the another operation signal provided by a gate driving unit of a previous stage, and respectively generate another corresponding scan signal.

13. The splicing display device as claimed in claim 1, further comprising a plurality of panels disposed in another column, wherein the control board further comprises another plurality of output terminals, and the another plurality of output terminals are coupled to the plurality of panels of the another column.

14. The splicing display device as claimed in claim 1, wherein the control board comprises:

a gamma circuit;

a timing control circuit;

a pulse width adjustment circuit;

a voltage converter, coupled to the timing control circuit and the output terminal; and a source driver, coupled to the gamma circuit, the timing control circuit, the pulse width adjustment circuit, and the output terminal, wherein the source driver generates and provides a data signal to the output terminal according to a gamma signal, a low-voltage differential signal, and a pulse modulation signal.

15. The splicing display device as claimed in claim 14, wherein the source driver provides a clock signal to the voltage converter, and the voltage converter is configured to boost the clock signal, and transmit the boosted clock signal to the output terminal to be output to the first panel and the second panel through the output terminal.

16. The splicing display device as claimed in claim 14, wherein the source driver provides the first signal and the second signal to the voltage converter, and the voltage converter is configured to boost the first signal and the second signal, and transmit the boosted first signal and second signal to the output terminal to be output to the first panel and the second panel through the output terminal.

17. The splicing display device as claimed in claim 1, wherein the output terminal comprises a plurality of pins.

18. The splicing display device as claimed in claim 1, wherein the first signal and the second signal are respectively start pulse signals.

19. The splicing display device as claimed in claim 1, wherein the control board, the first panel, and the second panel are coupled by a flexible flat cable.

20. The splicing display device as claimed in claim 1, wherein the first panel and the second panel further comprise a data line to respectively receive a data signal provided by the control board.

* * * * *